United States Patent [19]

Larinoff

[11] 3,968,836

[45] July 13, 1976

[54] HEAT EXCHANGER

[75] Inventor: Michael W. Larinoff, Houston, Tex.

[73] Assignee: Hudson Products Corporation, Houston, Tex.

[22] Filed: Aug. 5, 1974

[21] Appl. No.: 494,471

[52] U.S. Cl. ..... 165/111; 165/134; 165/DIG. 1; 137/59; 237/80

[51] Int. Cl.[2] ..... F28B 9/08

[58] Field of Search ..... 165/110, 111, 113, 122, 165/134, 71, DIG. 1; 137/59; 237/80

[56] References Cited

UNITED STATES PATENTS

| | | | |
|---|---|---|---|
| 1,582,372 | 4/1926 | Battle | 165/134 |
| 2,614,816 | 10/1952 | Hull | 165/111 |
| 3,304,005 | 2/1967 | Lytle, Sr. et al. | 237/80 X |
| 3,675,710 | 7/1972 | Ristow | 165/111 X |
| 3,789,919 | 2/1974 | Huber | 165/110 X |

FOREIGN PATENTS OR APPLICATIONS

| | | | |
|---|---|---|---|
| 1,185,248 | 3/1970 | United Kingdom | 165/110 |

*Primary Examiner*—Albert W. Davis, Jr.
*Attorney, Agent, or Firm*—W. F. Hyer; Marvin B. Eickenroht

[57] ABSTRACT

There is disclosed a heat exchanger wherein leg seals connecting with outlets from individual outlet headers of a heat exchanger are enclosed within a drain pot which is heated by vapor from one of the headers.

11 Claims, 12 Drawing Figures

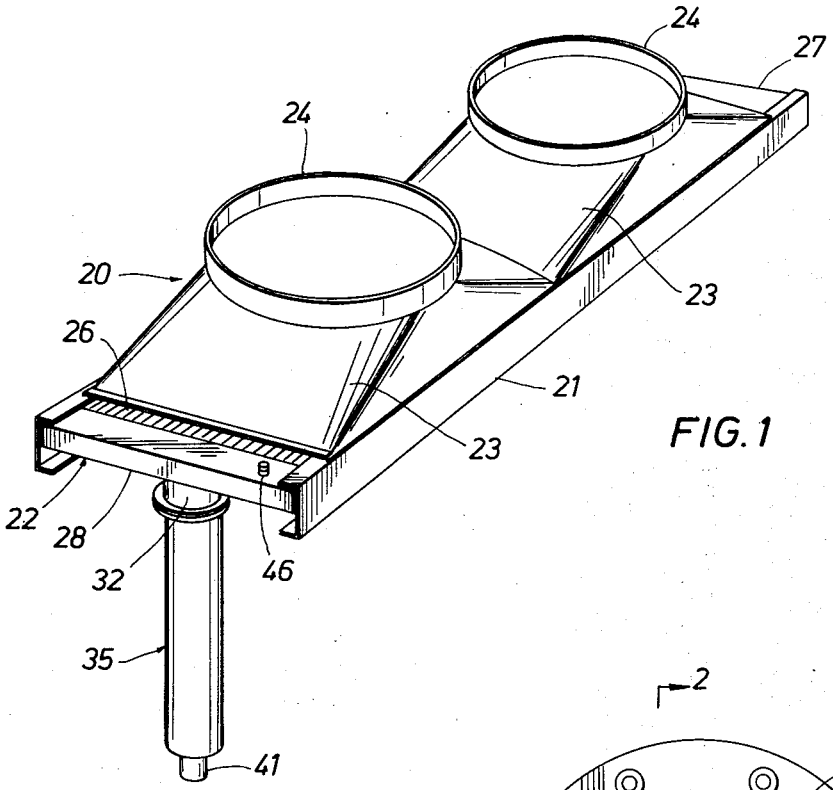
FIG. 1
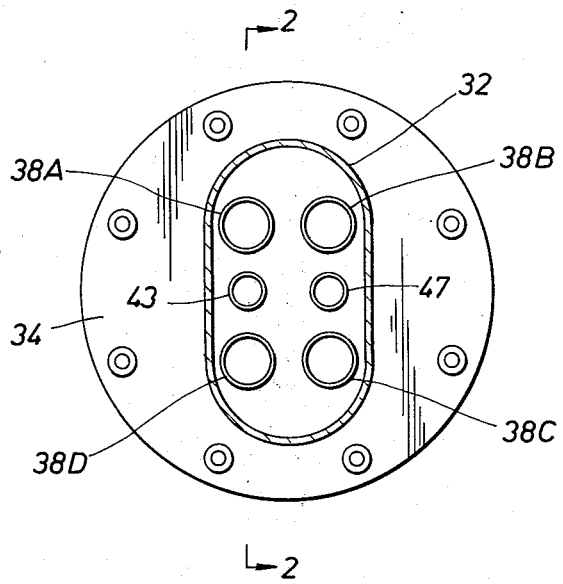
FIG. 6
FIG. 7
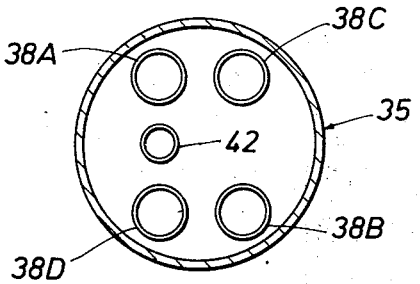
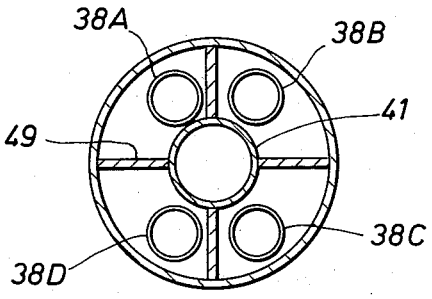
FIG. 8

HEAT EXCHANGER

This invention relates to heat exchangers of the general type having a bundle of tubes through which steam or other vapor is to be passed and arranged so that air is caused to flow past successive rows thereof. More particularly, it relates to improvements in heat exchangers of this type wherein each row of tubes is connected to a separate outlet header, and the several headers are in turn connected to a common vessel by means of individual leg seals.

Heat exchangers of this type are commonly used for condensing steam from the turbine exhaust of a power plant, although they may be used in condensing other vapors, and, for that matter, may be used to heat the air which is caused to pass over the tubes. In any case, however, since the air is warmed as it is caused to pass over the successive rows of tubes, it is coldest as it passes the first row and warmest as it passes the last row. As a result, steam in the successive rows is condensed at different rates, with the most steam being condensed in the first row, resulting in the largest pressure drop thereacross, and the least being condensed in the last row, resulting in the smallest pressure drop thereacross.

If the tubes of all rows are directly connected to a common condensate header, this pressure drop may cause steam to pass through the header from the tubes of the last row to those of the first row. Steam entering both ends of the tubes of the first row may trap pockets of non-condensibles in them causing the tube walls in the area of the pockets to become cool and thereby subjecting these tubes to freezing during cold ambient temperature conditions.

To protect against such freezing, it has been proposed to connect each row of tubes of such a heat exchanger with an individual outlet header, and connect outlets from the several headers to a common condensate vessel by means of leg seals which isolate the outlet ends of the tubes of rows from one another. This insures unidirectional steam flow in the tubes of all rows, thereby preventing the formation of pockets of non-condensibles in certain of the tubes and thus preventing the tubes from freezing.

Although they protect against freezing in the tubes in the bundle, prior heat exchangers of this latter type do not prevent the leg seals from freezing, and is is a primary object of this invention to provide such heat exchangers which do afford this additional protection.

A more particular object is to provide such heat exchangers in which the leg seals are warmed by heat from within the exchanger itself.

A further object is to provide heat exchangers of the type above described in which condensate in the common vessel may be easily and quickly drained in the event of shut down.

Yet another object is to provide heat exchangers of the type above described in which the condensate within the common vessel is substantially isolated from surges and disturbances in condensate flow from the individual leg seals.

A still further object is to provide heat exchangers of the type above described which are of compact construction, especially well suited for storage and/or transportation.

These and other objects are accomplished, in accordance with the illustrated embodiments of the present invention, by a heat exchanger of this type wherein leg seal tubes connecting with outlets from individual outlet headers extend downwardly within a generally upright drain pot, and condensate is maintained at a level with the drain pot above the lower ends of the tubes, whereby within the outlet headers are isolated from one another. More particularly, the drain pot includes an upper portion which surrounds the outlets so as to enclose and thereby protect the leg seal tubes from freezing ambient temperatures. Preferably, another tube connects one of the outlet headers above its lower end with the vessel above the condensate level therein, whereby uncondensed vapor from such header may be introduced into the vessel for heating the leg seals and thereby protecting them against freezing without the necessity of insulating the drain pot.

The condensate level is maintained in the drain pot by means of a drain pipe which extends through the lower end thereof, and there is a small hole just above the lower end of the pot. The hole is relative to the drain pipe so that ordinarily it will not affect the condensate level in the drain pot, and substantially all condensate will flow out of the drain pot through the drain pipe. However, upon shut down of the heat exchanger, condensate will automatically drain through the hole to prevent the drain pot from freezing. Also, baffles extend between the lower ends of the conduits within the drain pot to isolate surges and disturbances in in flow in the individual leg seals, the lower ends of the baffles being spaced above the lower end of the of the drain pot to permit condensate between the baffles to drain through the drain pipe.

Preferably, the outlet headers are contained in a box mounted on the end of the tube bundle, the drain pot is releasably connected to the box, and the leg seal tubes are carried within the drain pot. This not only simplifies construction of the outlet headers, but also permits the drain pot to be stored and transported separately thereof. In one embodiment of the invention, the outlets extend through the lower end of the box, and the upper portion of the drain pot is on the upper end thereof and is releasably connected to the lower end of the box. In another embodiment of the invention, the outlet extends through the outer side of the box, and the upper portion of the drain pot is on the inner side thereof and is releasably connected to the outer side of the box.

In the drawings, etc:

FIG. 1 is a perspective view of a heat exchanger constructed in accordance with the first mentioned embodiment of the invention, as seen from the top, one side and outlet end thereof;

FIG. 2 is a vertical sectional view of a central portion of the outlet header box and the drain pot at the outlet end of the air cooler, as seen along broken line 2—2 of FIG. 3; FIGS. 3, 4 and 5 are vertical sectional views of the outlet header box and drain pot, as seen along broken lines 3—3, 4—4 and 5—5, respectively, of FIG. 2;

FIGS. 6, 7 and 8 are horizontal sectional views of the header box and drain pot, as seen along broken lines 6—6, 7—7 and 8—8 of FIG. 3;

Figure 5:
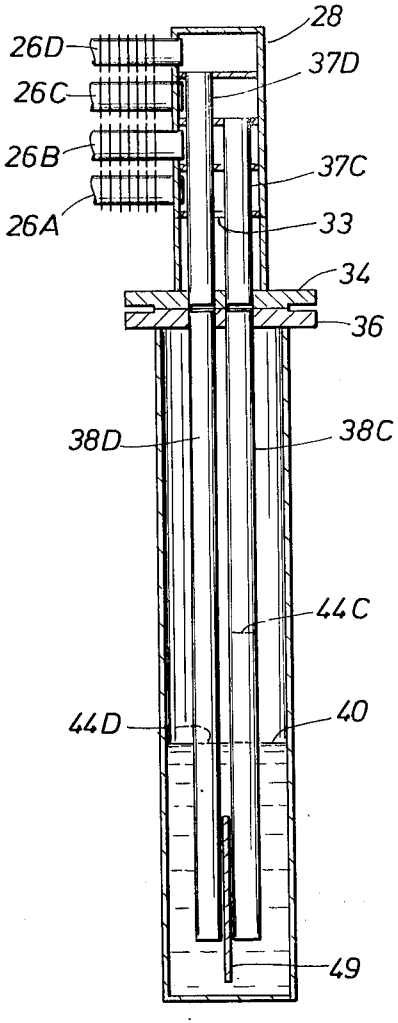
Figure 4:
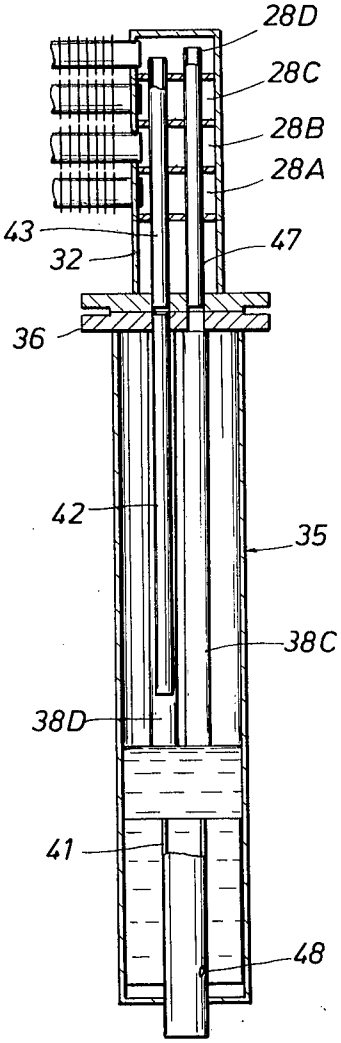
Figure 3:
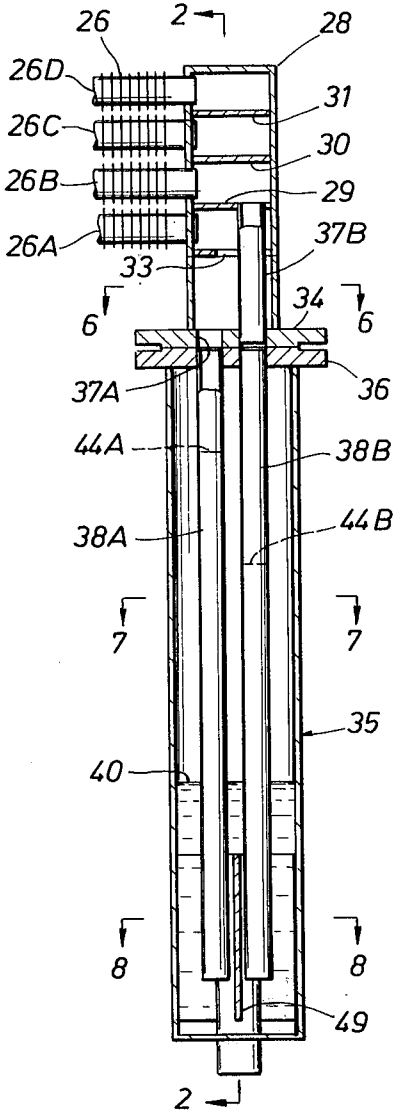
Figure 2:
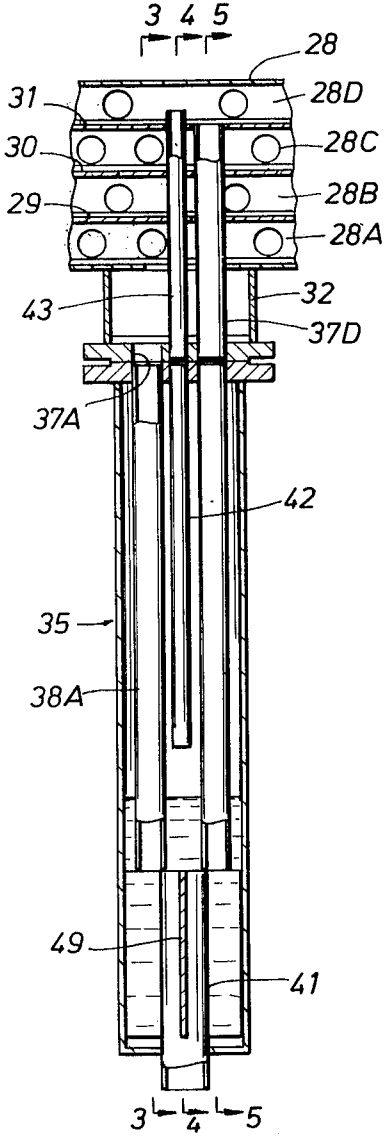

With reference now to the details of the above described drawings, the heat exchanger shown in FIG. 1, and designated in its entirety by reference character 20, includes a longitudinally extending channels 21, which may be mounted upon any suitable frame (not shown), and a tube bundle 22, mounted on the frame and comprising finned tubes 26 extending longitudinally between the channels 21 and connected at their opposite ends to an inlet header 27 and an outlet header box 28. A pair of plenums 23 are mounted on the channels 21 above the tube bundle 22 so as to confine the flow of air upwardly across the tubes into rings 24 in which fans (not shown) may be mounted for including such flow. During normal operation of the heat exchanger 20, steam or other condensible vapor is introduced into the inlet header 27, for passage through the tubes 26, where most of it is condensed by the flow of cooling air therepast, and condensate and uncondensed vapor is received in outlet headers within the box 28.

As shown in FIGS. 2 – 5, and by way of example, the tubes 26 are arranged in four vertical disposed rows 26A, 26B, 26C and 26D. With air being drawn upwardly therepast, the tubes of the row 26A are the first to be contacted by air, the tubes of the row 26D are the last to be contacted, and the tubes of the rows 26B and 26C are the second and third to be so contacted. As indicated in each of FIGS. 1 and 2, each row of tubes consists of a plurality of laterally spaced apart tubes.

As shown in FIGS. 3 – 5 and 9, the outlet ends of the tubes extend through a tube sheet across the inner side of the box, and walls 29, 30 and 31 extend laterally between the tube sheet and the outer side of the box to divide it into outlet headers 28A, 28B, 28C and 28D. As indicated by the letter suffixes, condensate and uncondensed vapor from the tubes of row 26A are received by the lowermost outlet header 28A, from the tubes of row 26B are received within the outlet header 28B, from the tubes of row 26C are received within the outlet header 28C, and from the tubes of the rows 26D are received within the outlet header 28D. A generally oval shaped transition 32 having a closed lower end 34 is mounted on a central portion of the bottom wall of the box 28 with its upper end surrounding an opening 33 in the bottom wall of the box so as to provide a downward extension of the lowermost outlet header 28A.

As previously described, since air is heated as it flows upwardly past the rows of tubes, more steam is normally condensed in each succeeding row or rows of tubes, resulting in a greater pressure drop in the tubes of that row. In order to isolate the unequal pressures in the individual outlet headers from one another, the outlet from each is connected to an individual leg seal, which in turn empties into a common condensate vessel.

In accordance with the present invention, the common vessel comprises a drain pot 35, having a closed upper end 36 releasably connected to the lower end wall 34 of the box extension 32. As shown the ends 34 and 36 have flanges which are bolted together with their opposite faces tightly engaged with one another to render the connection air tight. The outlets from the outlet headers comprise a hole 37A in the wall 34 34, providing an outlet from the lower end of the outlet header 28A, a tube 37B having a lower end connecting with another hole in the wall 34 and an upper end connecting with a hole in the wall 29 to provide an outlet from the lower end of the outlet header 28B, a tube 37C having a lower end connecting with a third hole in wall 34 and an upper end connecting with a hole in the wall 30 to provide an outlet from the lower end of outlet header 28C, and a tube 37D having a lower end connecting with a hole in the wall 31 to provide an outlet from the lower end of the uppermost outlet header 28D.

Four holes are also formed in the wall 36 of the drain pot 35 in alignment with the four holes in the wall 34, and additional tubes have their upper ends connected to the holes in the wall 36 to provide leg seals which extend downwardly within the drain pot. Thus, a leg seal tube 38A has its upper end connected to the hole aligned with the outlet 37A, a leg seal tube 38B has its upper end connected to the hole aligned with outlet 37B, a leg seal 38C has its upper end connected to the hole aligned with the outlet 37C, and a leg seal tube 38D has its upper end connected to a hole aligned with the outlet 37D. The lower ends of the leg seal tubes extend downwardly within the drain pot beneath the condensate level 40 therein, which is maintained at or above the upper end of a drain pipe 41 extending through the lower closed end of the drain pot.

In accordance with the preferred embodiment of the present invention, a tube 42 extends downwardly from a hole in the wall 36, with its lower end above the condensate level 40, and another tube 43 extends upwardly from an aligned hole in the wall 34, through the bottom wall of the housing 28 and the walls 29, 30 and 31, to communicate at its upper end with the upper outlet header 28D. More particularly, the upper end of the tube 43 extends above the condensate level within the header 28D, so that uncondensed vapors therein will pass through the tubes 42 and 43 into the drain pot 35 above the condensate level 40. Since this vapor is warm, it will heat the inside of the drain pot, and thus prevent the condensate from freezing, without the need for external electric heating cable tracing and heavy heat insulation about the drain pot.

Since the pressure within the drain pot above the condensate level is essentially the same as that within the outlet header 28D, the condensate level 44D within the leg seal tube 38D will be substantially the same as that within the drain pot. The condensate level within leg seal tube 38C will be at a higher level 44C, the condensate level within the leg seal tube 38B will be at a still higher level 44B, and the condensate level within the leg seal tube 38A will be at the highest level 44A, the differences between the respective levels being dependent upon the differences in pressure within the outlet headers.

Figure 9:
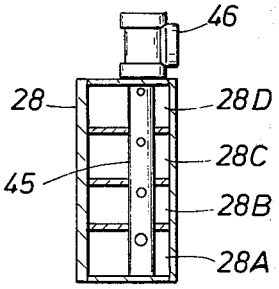
FIG. 9 is a vertical sectional view of an end portion of the header box, showing a pipe mounted therein for venting non-condensibles from the outlet headers.

Non-condensibles within the outlet headers is vented to the atmosphere through a common tube 45 (FIG. 9) extending upwardly through the walls 29, 30 and 31 as well as through the top wall of the box 28 for connection with a vent pipe 46. As shown in FIG. 9, ports of decreasing size connect the headers 28A – 28D with the interior of the vent tube. Non-condensibles within the drain pot 35 are also vented through the tubes 45, and, for this purpose, a tube 47 (see FIGS. 4 and 6) connects at its lower end with a hole in the wall 34 aligned with a hole in the wall 36, and extends upwardly through the lower end of the box 28, and the walls 29, 30 and 31, for communication at its upper end with the outlet header 28D.

Surges and other flow disturbances within the individual leg seal tubes are isolated from the other leg seal tubes by means of baffles 49 extending between them. Thus, as shown in FIG. 8, each such baffle comprises a wall extending radially outwardly from the drain tube 41 to the inner circumference of the drain pot 35, the walls being spaced substantially 90° apart. The upper ends of the baffles are aligned with the upper end of the tube 41 and are thus at all times above condensate flowing out of the lower end of the leg seal tubes, and the lower ends of the baffles are spaced above the bottom wall of the vessel.

A small port 48 is formed in the drain pipe 41 near the bottom wall of he vessel, so that in the event operation of the heat exchanger is discontinued, such as might occur in the event of expected freezing conditions, substantially all of the condensate within the drain pot 35 will drain therefrom. Even though the lower ends of all of three of the leg seal tubes are separated from port 48 by baffles 49, condensate within them will also drain automatically through the port 48 due to the communicating spaces beneath the lower ends of the baffles.

Figure 10:
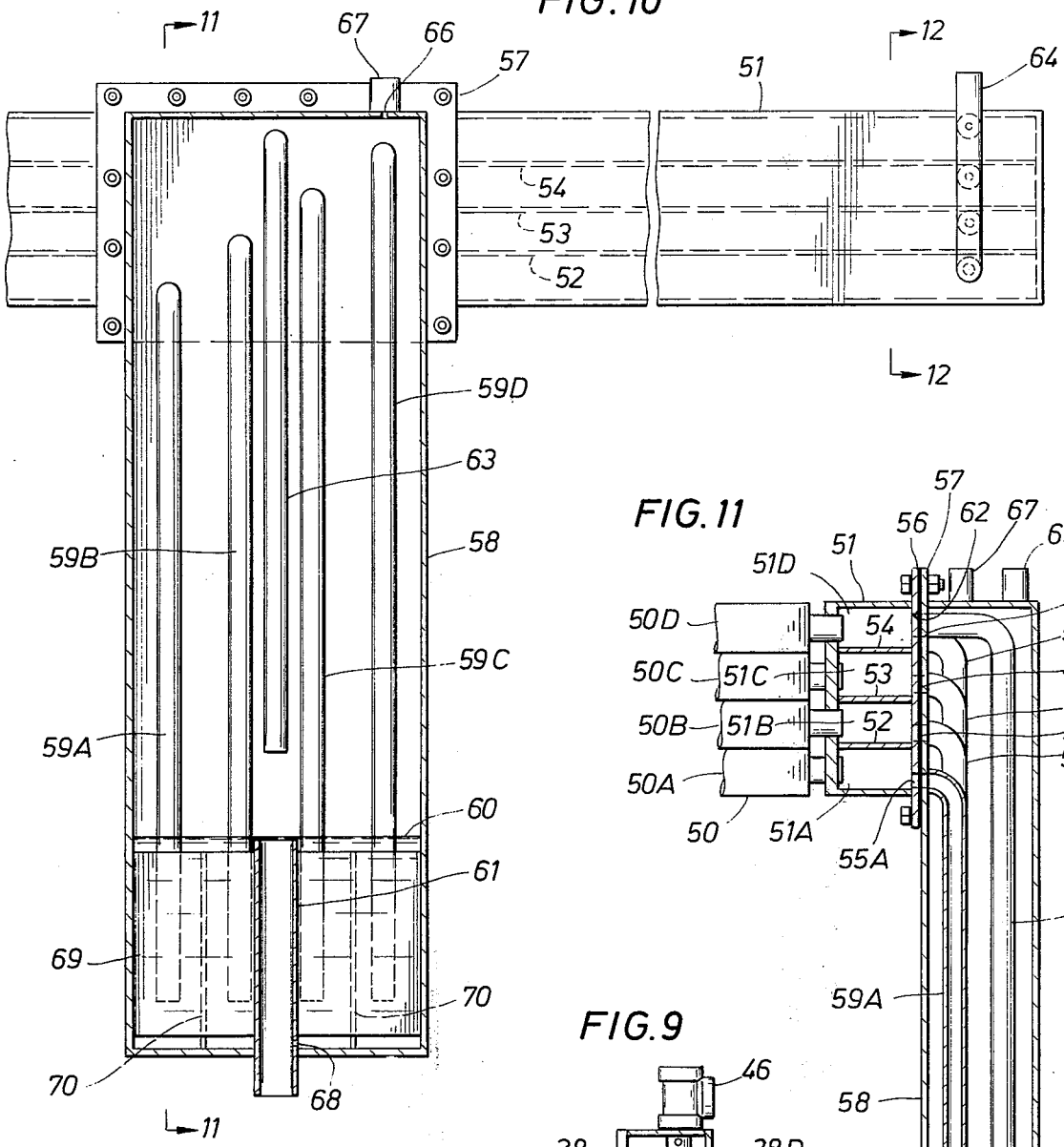
FIG. 10 is a view, partly in elevation and partly in section, of portions of the outlet header box and drain pot at the outlet end of a heat exchanger constructed in accordance with the second mentioned embodiment of the invention.
Figure 11:
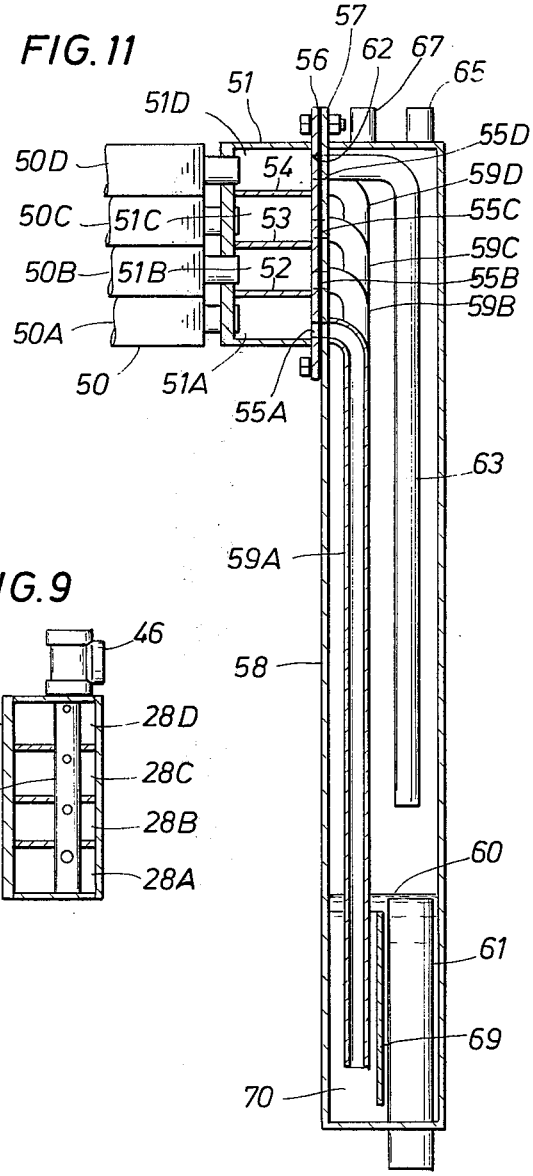
FIG. 11 is a vertical sectional view of the header box and drain pot shown in FIG. 10, as seen along broken line 11—11 thereof.
Figure 12:
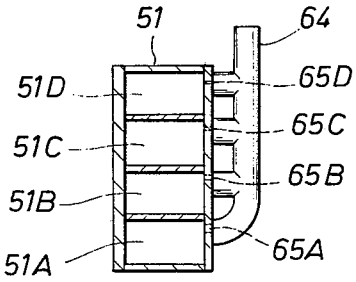
FIG. 12 is a vertical sectional view of an end portion of the header box, as seen along broken line 12—12 of FIG. 10, and showing a pipe mounted therein for venting non-condensibles from the outlet headers.

The embodiment of the invention illustrated in FIGS. 10 – 12 is the same as that illustrated in its entirety by FIG. 1, except for the construction of the outlet headers and drain pot. Thus, as shown in FIG. 11, and as in the heat exchanger 20, the tubes 50 of the tube bundle are arranged in four rows 50A, 50B, 50C and 50D, adapted to be successively contacted by air flowing in an upward direction. Also, the outlet ends of the tubes extend through a tube sheet forming the inner side wall of an outlet header box 51, which is divided by walls 52, 53 and 54 into outlet headers 51A, 51B, 51C and 51D connecting, respectively, with the tubes of the rows 50A, 50B, 50C and 50D.

However, in the second embodiment of the invention, outlets from the outlet headers are formed in the outer side wall of the outlet header box 51. Thus, as shown in FIG. 11, holes extend through the outer wall adjacent the bottom of each outlet box to provide outlets 55A, 55B, 55C and 55D, respectively, from the outlet headers 51A, 51B, 51C and 51D. As shown in FIGS. 10 – 11, the outer wall of he outlet header box 51 is provided with a flange 56 to which a flange 57 on the inner side of the upper portion of a drain pot 58 may be connected; and, as in the case of the first embodiment, leg seal tubes are mounted within the drain pot for connection of their upper ends with the outlets 55A – 55D from the outlet headers upon connection of the drain pot to the outlet header box.

Thus, a leg seal tube 59A is bent at its upper end for connection with a hole in the flange 57 aligned with outlet 55A, a leg seal tube 59B is bent at its upper end for connection with a hole in the flange 57 aligned with outlet 55B, a leg seal tube 59C is bent at its upper end for connection with a hole in the flange 57 aligned with the outlet 55C, and a leg seal tube 59D is bent at its upper end for connection with a hole in the flange 57 aligned with the outlet 55D. As in the case of the leg seals of the first embodiment, leg seal tubes 59A – 59D have their lower ends extending downwardly into the lower portion of the drain pot beneath a condensate level 60 therein. As was also true of the first embodiment, the level 60 is maintained by means of the upper open end of a drain pipe 61 extending through the closed bottom wall of the drain pot 58.

As was also true in the first embodiment, the leg seal tubes within the drain pot are heated and thus prevented from freezing by uncondensed vapor from the uppermost outlet header 51D. For this purpose, a hole 62 is formed in the rear wall of the box 51 to connect with the outlet header 51D above the condensate level therein, and a tube 63 has an upper end bent to connect with a hole in the flange 57 aligned with the hole 62, and a lower end which terminates above the condensate level 60.

As shown in FIGS. 10 and 12, non-condensibles are vented from outlet headers by means of a manifold pipe 64 located at one end of the box 51 and connecting with holes 65A, 65B, 65C and 65D through the rear wall of the box opposite outlet headers 51A, 51B, 51C and 51D, respectively. Non-condensibles within the drain pot 58 are vented to the atmosphere through a hole 66 in the top wall of the drain pot 58, which in turn connects with a vent pipe 67 extending upwardly therefrom.

The lower end of the leg seal tubes are isolated from one another by means of baffles, including a wall 69 which extends laterally of the drain pot 58 between the drain pipe 61 and the lower ends of the leg seals, and walls 70 which extend from the wall 69 to the fron wall of the drain pot 58 between adjacent leg seals, as best shown in FIG. 10. This baffle arrangement differs from that of the first described embodiments due to the fact that the leg seal tubes extend in side-by-side relation within a generally rectangular drain pot, rather than in generally equally spaced-apart relation about the center of a generally cylindrically shaped drain pot, as in the first embodiment. The lower end of the wall 69 is spaced above the bottom of the drain pot, but below the lower ends of the leg seal tubes, so as to substantially isolate flow disturbances in each leg seal tube from the others, but at the same time permit all to drain through the drain tube 61.

As is also the case in the first described embodiment, the drain pipe 61 is provided with a small port 68 therein communicating with the interior of the drain pot just above the bottom thereof. Thus, as previously described, when the heat exchanger is shut down, condensate within the drain pot, including that within the leg seals, will automatically drain therefrom.

From the foregoing it will be seen that this invention is one well adapted to attain all of the ends and objects hereinabove set forth, together with other advantages which are obvious and which are inherenct to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A heat exchanger, comprising a tube bundle having a plurality of rows of tubes adapted to be arranged successively in the direction of air flow therepast, an inlet header for introducing vapor into one end of the tubes of the rows, a plurality of outlet headers each for receiving condensate and uncondensed vapor from the opposite ends of the tubes of one of said rows, each outlet header having an outlet from the lower end thereof, a generally upright drain pot having an upper portion which surrounds said outlets, a plurality of leg seal tubes each connecting with the outlet from one of the outlet headers and extending into a lower portion of the drain pot, means for maintaining the level of condensate within the drain pot above the lower ends of the leg seal tubes so as to isolate pressures within said outlet headers from one another, and an additional tube connecting one outlet header above its lower end with the drain pot above the condensate level therein so as to introduce uncondensed vapor from said one outlet header into said drain pot.

2. A heat exchanger of the character defined in claim 1, wherein the row of tubes from which said one outlet header receives vapor is the last to be contacted by said air flow.

3. A heat exchanger of the character defined in claim 2, wherein the means for maintaining the condensate level in the drain pot comprises a drain pipe extending through the lower end of said drain pot, and a hole is formed in the drain pipe close to the lower end of the drain pot to permit drainage of substantially all of the condensate therefrom.

4. A heat exchanger of the character defined in claim 2, wherein the means for maintaining condensate level in the drain pot comprises a drain pipe through the lower end thereof, and baffles extend between the lower ends of the leg seal tubes in the drain pot.

5. A heat exchanger of the character defined in claim 4, wherein the lower ends of the baffles are spaced above the lower ends of the drain pot, and there is a hole in the drain pipe just above the lower end of the drain pot.

6. A heat exchanger of the character defined in claim 1, wherein the means for maintaining the condensate level in the drain pot comprises a drain pipe extending through the lower end of said drain pot, and a hole is formed in the drain pipe close to the lower end of the drain pot to permit drainage of substantially all of the condensate therefrom.

7. A heat exchanger of the character defined in claim 1, wherein the means for maintaining the condensate level in the drain pot comprises a drain pipe extending through the lower end of said drain pot, and baffles extend between the lower ends of the leg seal tubes in the drain pot.

8. A heat exchanger of the character defined in claim 7, wherein the lower ends of the baffles are spaced above the lower end of the drain pot, and there is a hole in the drain pipe just above the lower end of the drain pot.

9. A heat exchanger of the character defined in claim 1, wherein the outlet headers are formed within a box mounted on the end of the tube bundle, the drain pot is releasably connected to the box, and the leg seal tubes are carried within the drain pot.

10. A heat exchanger of the character defined in claim 9, wherein the outlets extend through the lower end of the box, and the upper portion of the drain pot is on the upper end thereof and is releasably connected to the lower end of the box.

11. A heat exchanger of the character defined in claim 9, wherein the outlets extend through the outer side of the box and the upper portion of the drain pot is on the inner side thereof and is releasably connected to the outer side of the box.

* * * * *